US008701754B2

(12) United States Patent
McCulloch

(10) Patent No.: US 8,701,754 B2
(45) Date of Patent: Apr. 22, 2014

(54) COILED TUBING INJECTOR WITH STRAIN RELIEF

(71) Applicant: David W. McCulloch, Arlington, TX (US)

(72) Inventor: David W. McCulloch, Arlington, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/775,059

(22) Filed: Feb. 22, 2013

(65) Prior Publication Data

US 2013/0333900 A1 Dec. 19, 2013

Related U.S. Application Data

(60) Provisional application No. 61/661,238, filed on Jun. 18, 2012.

(51) Int. Cl.
*E21B 19/22* (2006.01)
*E21B 19/00* (2006.01)

(52) U.S. Cl.
USPC ..... 166/77.3; 166/385

(58) Field of Classification Search
USPC ..... 166/77.1, 77.2, 77.3, 384, 385
See application file for complete search history.

(56) References Cited

U.S. PATENT DOCUMENTS

| | | | |
|---|---|---|---|
| 2,282,597 | A | 5/1942 | Archer |
| 2,567,009 | A | 9/1951 | Calhoun et al. |
| 2,896,777 | A | 7/1959 | Hallam |
| 3,056,535 | A | 10/1962 | Baugh et al. |
| 3,182,877 | A | 5/1965 | Slator et al. |
| 3,216,639 | A | 11/1965 | Andre |
| 3,285,485 | A | 11/1966 | Slator |
| 3,373,818 | A | 3/1968 | Rike et al. |
| 3,401,749 | A | 9/1968 | Daniel |
| 3,559,905 | A | 2/1971 | Palynchuk |
| 3,618,840 | A | 11/1971 | Courret |
| 3,638,288 | A | 2/1972 | Pryor |

(Continued)

FOREIGN PATENT DOCUMENTS

| | | | |
|---|---|---|---|
| CA | 953644 | A | 8/1974 |
| CA | 1056808 | A | 6/1979 |

(Continued)

OTHER PUBLICATIONS

International Search Report and Written Opinion received in Patent Cooperation Treaty Application No. PCT/US2011/049684, Nov. 29, 2011, 11 pages.

(Continued)

*Primary Examiner* — Giovanna Wright
*Assistant Examiner* — Michael Wills, III
(74) *Attorney, Agent, or Firm* — Hubbard Law, PLLC

(57) ABSTRACT

A coiled tubing injector, rollers on the backside of grippers on a gripper chain pass over at least one shallow groove or depression formed in, or gap between segments of, a planar roller contact surface of a skate, thereby momentarily removing or reducing the force being applied by the skate to the grippers as the grippers pass through at least one predetermined location within a gripping zone of the coiled tubing injector. The reduction or removal of the force on the grippers allows the grippers to reset their positions on the tubing at one or more predetermined locations in order to accommodate changes in the strain caused by changes in stress as the tubing moves through the injector.

13 Claims, 4 Drawing Sheets

(56) References Cited

U.S. PATENT DOCUMENTS

| | | | | |
|---|---|---|---|---|
| 3,667,554 | A | 6/1972 | Smitherman | |
| 3,690,136 | A | 9/1972 | Slator et al. | |
| 3,724,567 | A | 4/1973 | Smitherman | |
| 3,778,094 | A | 12/1973 | Grolet et al. | |
| 3,822,559 | A | 7/1974 | Matthews et al. | |
| 3,824,875 | A | 7/1974 | Willert et al. | |
| 3,827,487 | A | 8/1974 | Jackson et al. | |
| 3,866,882 | A | 2/1975 | Willm et al. | |
| 3,920,076 | A | 11/1975 | Laky | |
| 4,013,205 | A | 3/1977 | Fabre-Curtat et al. | |
| 4,172,391 | A | 10/1979 | Dressel | |
| 4,585,061 | A | 4/1986 | Lyons, Jr. et al. | |
| 4,655,291 | A | 4/1987 | Cox | |
| 4,899,620 | A | 2/1990 | Schiffer | |
| 5,133,405 | A | 7/1992 | Elliston | |
| 5,188,174 | A | 2/1993 | Anderson, Jr. | |
| 5,234,053 | A | 8/1993 | Connell | |
| 5,309,990 | A | 5/1994 | Lance | |
| 5,381,861 | A | 1/1995 | Crafton et al. | |
| 5,533,659 | A | 7/1996 | Meyer | |
| 5,553,668 | A | 9/1996 | Council et al. | |
| 5,566,764 | A | 10/1996 | Elliston | |
| 5,775,417 | A | 7/1998 | Council | |
| 5,850,874 | A | 12/1998 | Burge et al. | |
| 5,853,118 | A | 12/1998 | Avakov | |
| 5,890,534 | A | 4/1999 | Burge et al. | |
| 5,918,671 | A | 7/1999 | Bridges et al. | |
| 5,937,943 | A | 8/1999 | Butler | |
| 5,975,203 | A | 11/1999 | Payne et al. | |
| 6,059,029 | A | 5/2000 | Goode | |
| 6,135,202 | A | 10/2000 | Koshak | |
| 6,173,769 | B1 | 1/2001 | Goode | |
| 6,209,634 | B1 * | 4/2001 | Avakov et al. | 166/77.3 |
| 6,216,780 | B1 | 4/2001 | Goode et al. | |
| 6,332,501 | B1 | 12/2001 | Gipson | |
| 6,347,664 | B1 | 2/2002 | Perio, Jr. | |
| 6,516,891 | B1 | 2/2003 | Dallas | |
| 6,609,566 | B2 * | 8/2003 | Perio, Jr. | 166/77.3 |
| 6,880,629 | B2 | 4/2005 | Schroeder | |
| 6,910,530 | B2 | 6/2005 | Austbo et al. | |
| 7,124,815 | B2 * | 10/2006 | Rosine et al. | 166/77.3 |
| 7,150,330 | B2 | 12/2006 | Domann | |
| 7,383,879 | B2 | 6/2008 | Kulhanek et al. | |
| 7,431,097 | B2 | 10/2008 | Weightmann | |
| 2003/0034162 | A1 | 2/2003 | Kulhanek | |
| 2005/0205267 | A1 | 9/2005 | Dallas | |
| 2006/0076148 | A1 | 4/2006 | Kulhanek et al. | |
| 2007/0246261 | A1 | 10/2007 | Lowe et al. | |
| 2009/0091278 | A1 | 4/2009 | Montois et al. | |
| 2009/0250205 | A1 | 10/2009 | Koopmans et al. | |
| 2013/0112433 | A1 * | 5/2013 | Armstrong et al. | 166/385 |

FOREIGN PATENT DOCUMENTS

| | | | |
|---|---|---|---|
| CA | 1096850 | A | 3/1981 |
| EP | 0507280 | A | 10/1992 |
| EP | 0524648 | A | 1/1993 |
| GB | 2029478 | A | 3/1980 |
| GB | 2247260 | A | 2/1992 |
| WO | 0008296 | A | 2/2000 |
| WO | 2005003505 | A | 1/2005 |

OTHER PUBLICATIONS

International Search Report and Written Opinion received in Patent Cooperation Treaty Application No. PCT/US2012/053397, Mar. 19, 2013, 12 pages.

* cited by examiner

COILED TUBING INJECTOR WITH STRAIN RELIEF

This application claims the benefit of U.S. application No. 61/661,238, filed Jun. 18, 2012, which is incorporated herein by reference for all purposes.

BACKGROUND

"Coiled tubing injectors" are machines for running pipe into and out of well bores. Typically, the pipe is continuous, but injectors can also be used to raise and lower jointed pipe. Continuous pipe is generally referred to as coiled tubing since it is coiled onto a large reel when it is not in a well bore. The terms "tubing" and "pipe" are, when not modified by "continuous," "coiled" or "jointed," synonymous and encompass both continuous pipe, or coiled tubing, and jointed pipe. "Coiled tubing injector" and, shortened, "injector" refer to machines used for running any of these types of pipes or tubing. The name of the machine derives from the fact that it is typically used for coiled tubing and that, in preexisting well bores, the pipe must be literally forced or "injected" into the well through a sliding seal to overcome the pressure of fluid within the well, until the weight of the pipe in the well exceeds the force produced by the pressure acting against the cross-sectional area of the pipe. However, once the weight of the pipe overcomes the pressure, it must be supported by the injector. The process is reversed as the pipe is removed from the well.

Coiled tubing is faster to run into and out of a well bore than conventional jointed or straight pipe and has traditionally been used primarily for circulating fluids into the well and other work over operations, but can be used for drilling. For drilling, a turbine motor is suspended at the end of the tubing and is driven by mud or drilling fluid pumped down the tubing. Coiled tubing has also been used as permanent tubing in production wells. These new uses of coiled tubing have been made possible by larger diameters and stronger pipe.

Examples of coiled tubing injectors include those shown and described in U.S. Pat. Nos. 5,309,990, 6,059,029, and 6,173,769, all of which are incorporated herein by reference.

A typical coiled tubing injector is comprised of two continuous chains, though more than two can be used. The chains are mounted on sprockets to form elongated loops that counter rotate. A drive system applies torque to the sprockets to cause them to rotate, resulting in rotation of the chains. In most injectors, chains are arranged in opposing pairs, with the pipe being held between the chains. Grippers carried by each chain come together on opposite sides of the tubing and are pressed against the tubing. The injector thereby continuously grips a length of the tubing as it is being moved in and out of the well bore. The "grip zone" or "gripping zone" refers to the zone in which grippers come into contact with a length of tubing passing through the injector.

Several different arrangements can be used to push the grippers against the tubing. One common arrangement uses a skate to apply an even force to the back of the grippers as they pass through the grip zone. In one example, each gripper has a cylindrical roller, or multiple rollers with the same axis of rotation, mounted to its back. The rollers roll along a continuous, planar surface formed by the skate as the grippers pass through the gripping zone. By properly positioning the skate with respect to the tubing, the skate can push the grippers against the tubing with a force or pressure that is normal to the tubing. In an alternative arrangement rollers are mounted on the skate, and the back of the grippers have a flat or planar surface that ride along the rollers. The axes of the rollers are co-planar, so that the periphery of the rollers engage the back of the skates in the same plane, thus effectively presenting a planar rolling surface on which grippers may roll.

A coiled tubing injector applies a normal force to its grippers and that normal force through friction creates an axial force along the longitudinal axis of the tubing. The amount of traction between the grippers and the tubing is determined, at least in part, by the amount of this force. In order to control the amount of the normal force, skates for opposing chains are typically pulled toward each other by hydraulic pistons or a similar mechanism to force the gripper elements against the tubing. Alternatively, skates are pushed toward each other.

SUMMARY

The invention relates generally to a traction system for a coiled tubing injector that relieves elastic strain in tubing as tubing passes through the gripping zone. Momentarily removing or reducing the normal force on a gripper at an intermediate location within a gripping zone, thus momentarily removing or reducing the axial force imparted by the gripper on the tubing, allows strain in at least the tubing to be relieved by relative motion of the gripper with respect to the tubing, without the injector losing traction as a whole on the tubing and allowing it to slip. When the normal force is reapplied the gripper again produces an axial force pulling on the tubing.

In one representative embodiment of a coiled tubing injector, a planar surface of a skate, along which grippers of a gripping chain move, includes an intermediate interruption in the surface that momentarily reduces or removes the force being applied by the skate, allowing the gripper to reposition itself on the tubing.

In another representative embodiment of a coiled tubing injector, rollers on the backside of grippers on a gripper chain pass over at least one shallow groove or depression formed in, or gap between segments of, a planar roller contact surface of a skate, thereby momentarily removing or reducing the force being applied by the skate to the grippers as they pass through at least one predetermined location within a gripping zone of the coiled tubing injector. The reduction or removal of the force allows the grippers on the gripper chain to reset their positions on the tubing at one or more predetermined locations in order to accommodate changes in the strain caused by changes in stress as the tubing moves through the injector.

DETAILED DESCRIPTION OF EXEMPLARY EMBODIMENTS

In the following description, like numbers refer to like elements.

Figure 1:
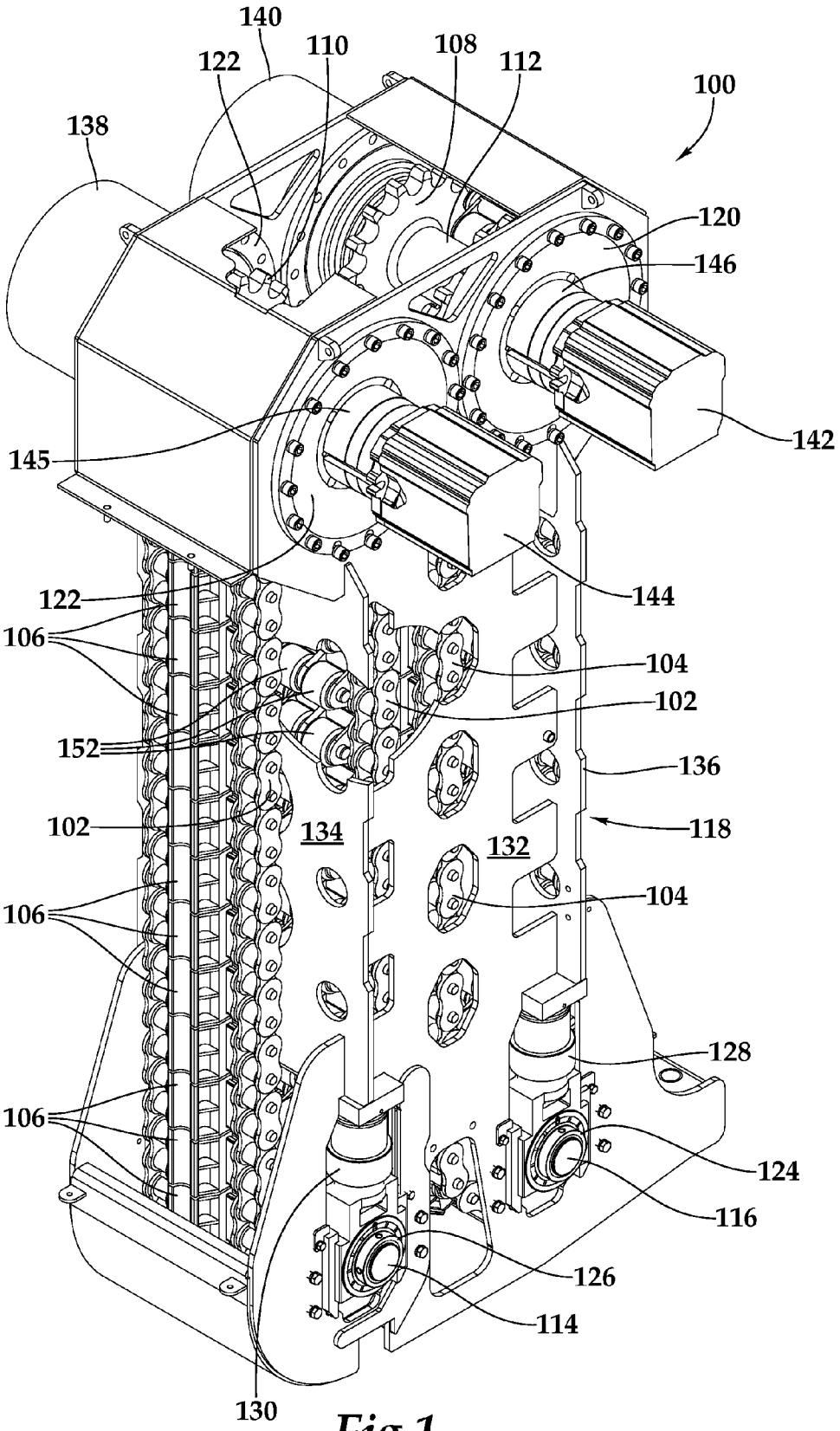
FIG. 1 is a perspective view of a representative coiled tubing injector.
Figure 2:
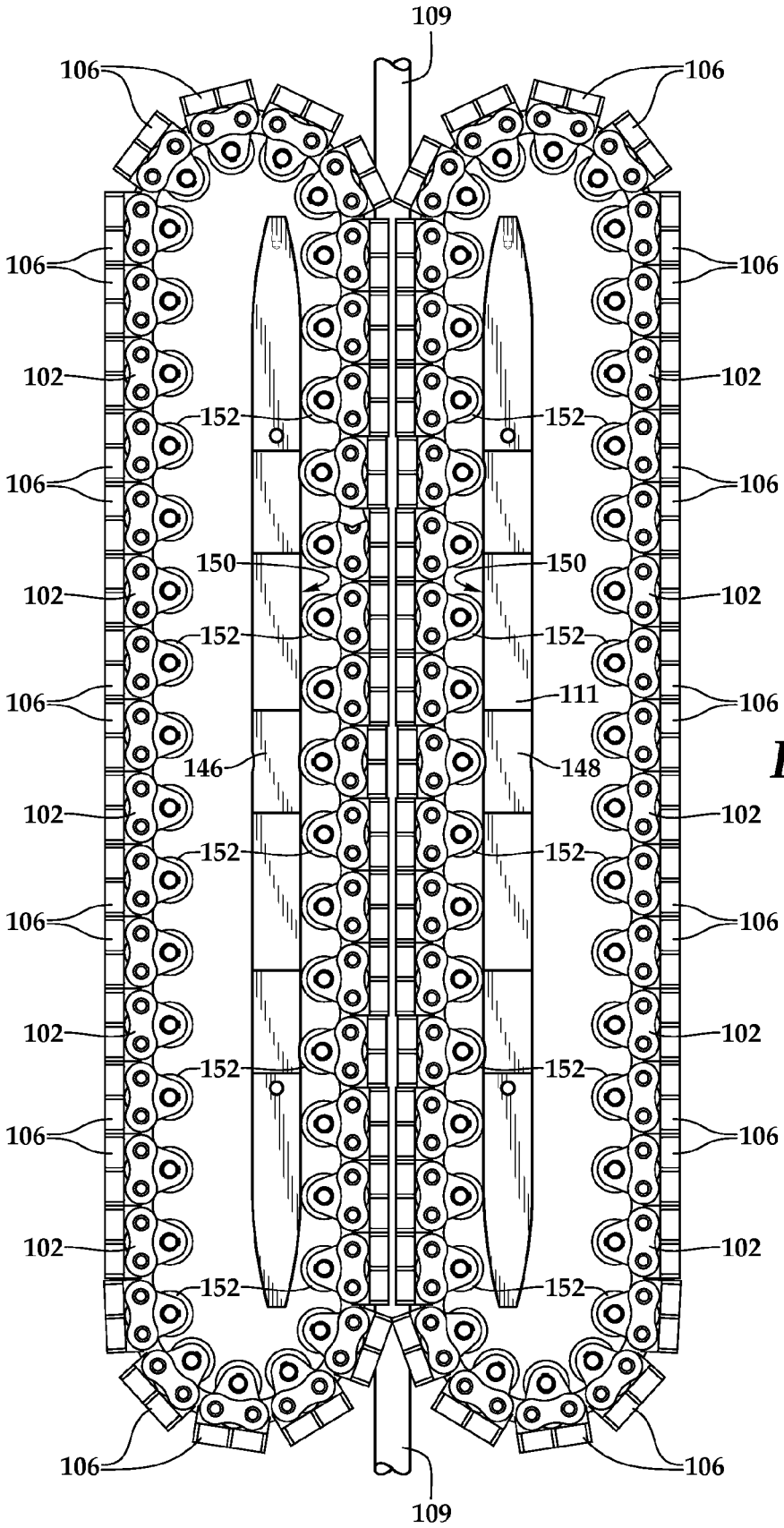
FIG. 2 is a plan view of only the chain, mounted with gripper elements, and a skate of the representative coiled tubing injector of claim 1.
Figure 3:
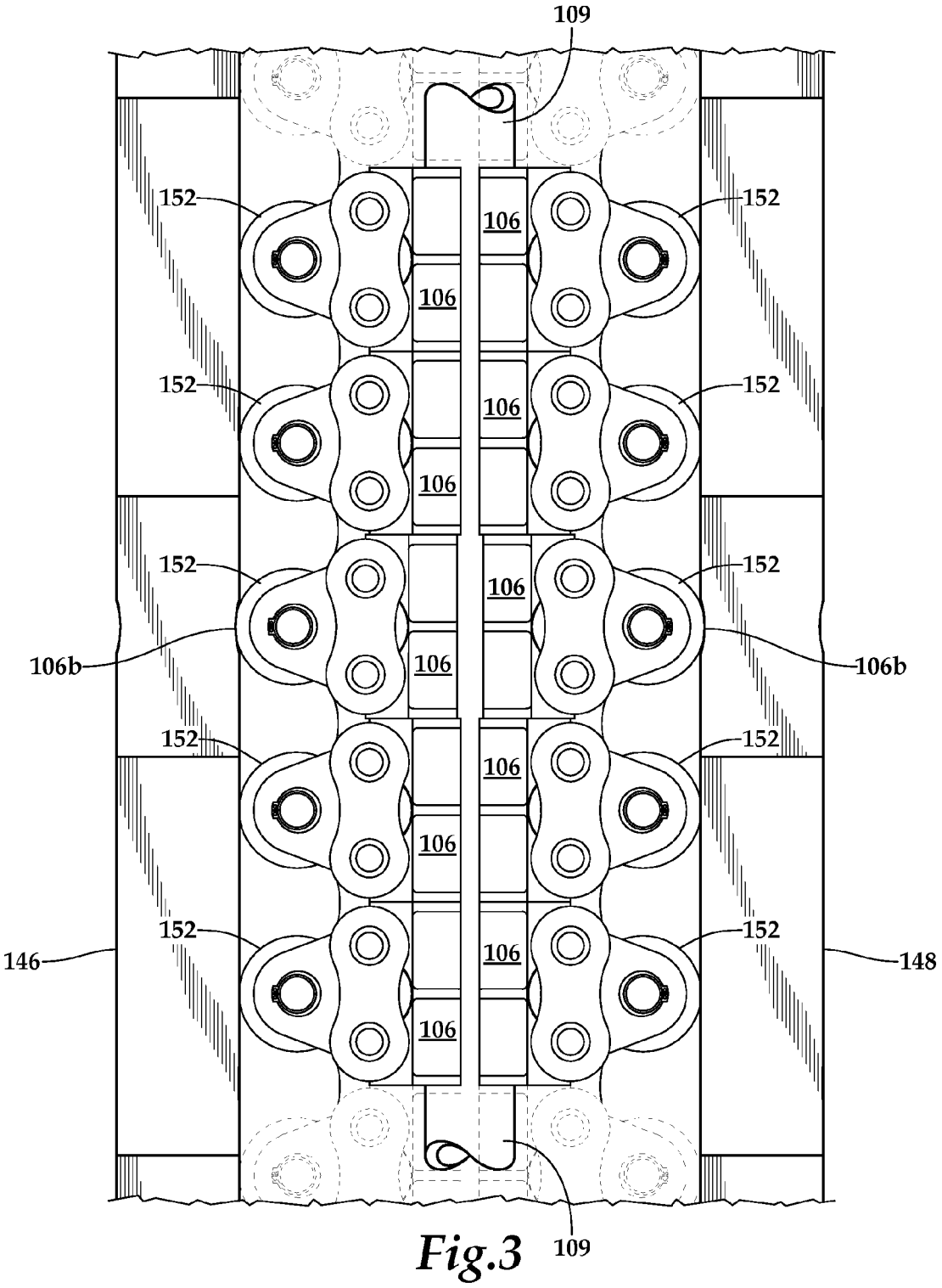
FIG. 3 is a detail view of FIG. 2.
Figure 4:
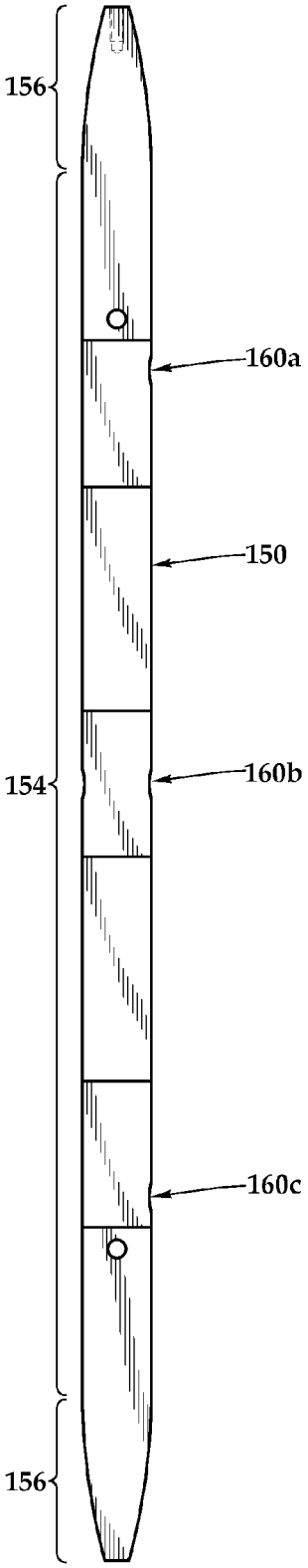
FIG. 4 is a side view, showing its profile, of one of the skates shown in FIGS. 2 and 3.
Figure 5:
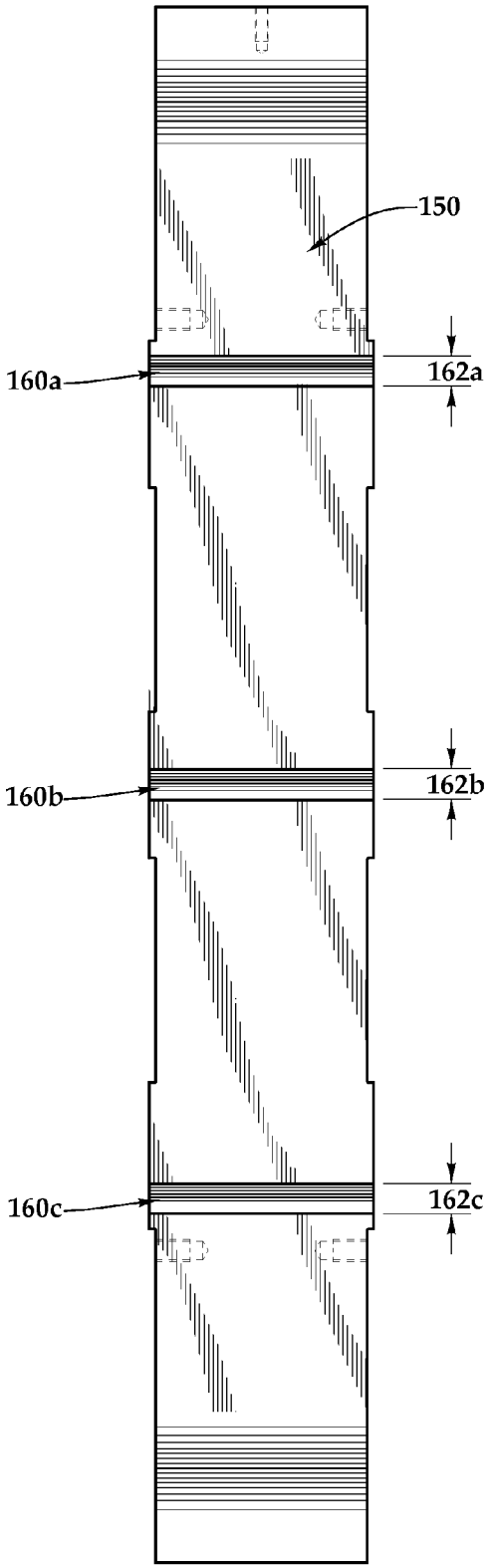
FIG. 5 is a plan view of the skate of FIG. 4.

Referring to FIGS. 1, 2 and 3, injector 100 is intended to be generally representative of coiled tubing injectors. It has two, counter rotating drive chains 102 and 104. Each of the chains carry a plurality of gripping elements or grippers 106. The chains are thus sometimes also referred to as gripper chains. Each of the grippers on a chain is shaped to conform to, or complement, the outer diameter or outer surface curvature of tubing 109 (not shown in FIG. 1) that will be gripped. In one embodiment, the grippers may be comprised of a carrier, which is connected with the chain, and a shoe for engaging the tubing. The shoe may also, in some embodiments, be removable or replaceable. The grippers on the respective chains come together in an area referred to as a gripping zone. As the tubing 109 passes through the injector it enters the gripping zone. On the gripping zone, the grippers from each of the chains cooperate to grip the tubing and substantially encircle the tubing to prevent it from being deformed. In this example, the gripping zone is substantially straight, with the sections of the respective chains within the gripping zone extending straight and parallel to each other. The center axis of the tubing is coincident with a central axis of the gripping zone. In the illustrated example, which has only two chains, chains 102 and 104 revolve generally within a common plane. (Please note that, in FIG. 1, chains 102 and 104 are cut away at the top of the injector in order to reveal the sprockets on which they are mounted.) Injectors may comprise more than two drive chains. For example, a second pair of drive chains can be arranged in an opposing fashion within a plane that is ninety degrees to the other plane, so that four gripping elements come together to engage the tubing as it passes through the injector.

Referring now only to FIG. 1, chains of an injector are mounted or supported on at least two sprockets, one at the top and the other at the bottom of the injector. The upper and lower sprockets are, in practice, typically comprised of two spaced-apart sprockets that rotate around a common axis. In the representative example of FIG. 1, only one of each pair of sprockets 108 and 110 is visible. (The sprockets are not indicated in FIGS. 2 and 3.) The upper sprockets in this example of an injector are driven. The drive sprockets are connected to a drive axle or shaft that is rotated by a drive system. Only one shaft, referenced by number 112, for upper drive sprocket pair 108, is visible in FIG. 1. The lower sprockets, which are not visible in the figures, except for the end of shafts 114 and 116 to which they are connected, are not driven in this representative injector. They are referred to as idler sprockets. The lower sprockets could, however, be driven, either in place of or in addition to, the upper sprockets. Furthermore, additional sprockets could be added to the injector for the purpose of driving each of the chains.

The sprockets are supported by a frame generally indicated by the reference number 118. The shafts for the upper sprockets are held on opposite ends by bearings. These bearings are located within two bearing housings 120 for shaft 112 and two bearing housings 122 for the other shaft that is not visible. The shafts for the lower sprockets are also held on opposite ends by bearings, which are mounted within moveable carriers that slide within slots with the frame. Only two front side bearings 124 and 126 can be seen in the figures. Allowing the shafts of the lower sprockets to move up and down permits the chains to be placed under constant tension by hydraulic cylinders 128 and 130.

The frame 118, in this particular example of an injector, takes the form of a box, which is formed from two, parallel plates, of which plate 132 is visible in the drawing, and two parallel side plates 134 and 136. The frame supports sprockets, chains, skates and other elements of the injector, including a drive system and brakes 138 and 140. Each brake is coupled to a separate one of the drive shafts, on which the upper sprockets are mounted. In a hydraulically powered system, the brakes are typically automatically activated in the event of a loss of hydraulic pressure.

A drive system for the injector is comprised of at least one motor, typically hydraulically driven, but electric motors are also used. Injector 100 has two motors 142 and 144, one for each of the gripper chains. More motors could be added for driving each chain, for example by connecting them to the same shaft, or by connecting them to a separate sprocket on which the chain is mounted. The output of each motor is coupled to the shaft of the drive sprocket for the chain being driven by the motor, the motor thereby also being coupled with the chain. Each motor is coupled either directly or indirectly, such as through an arrangement of gears, an example of which is a planetary gear box 145. However, only one motor can be used. It can drive either just one chain (with the other not being driven) or both chains by coupling it, directly or indirectly, through gearing a drive sprocket for each chain. Examples of such gearing include a differential gear drive with multiple outputs or by gears coupling the two drive sockets. If a hydraulic motor is used, it is supplied, when the injector is put into operation, with pressurized hydraulic fluid received over hydraulic lines connected with a power pack, the power pack comprising a hydraulic pump powered by, for example, a diesel engine. The same power pack can be used to operate other hydraulic circuits, including hydraulic cylinders for generating a gripping force, as described below.

Referring to FIGS. 1-5, although not visible in FIG. 1, coiled tubing injector 100 includes for each chain 102 and 104 a skate 146 and 148, respectively, for pressing gripping elements 106 within the gripping zone against tubing 109. The skates apply a normal force to the gripping elements, which transfer that force to the tubing to generate frictional force (referred to as the gripping force) for holding the tubing as it passes through the gripping zone. The greater the normal force, the greater the gripping force. The normal force is generated in part by a plurality of hydraulic cylinders. The cylinders are not shown in the figures. In one embodiment, each of the hydraulic cylinders are connected at a discrete position along the length of the gripping zone, one end to each of the two skates. They generate equal forces to pull together the skates at multiple points along their lengths, thereby applying uniform gripping pressure against the tubing 109 along the length of the skates. Multiple hydraulic cylinders could, in alternative embodiments, be arranged to push the skates toward each other.

In order to avoid deforming or damaging the pipe, the skate applies the normal force uniformly along the length tubing within the gripping zone, when the gripping elements have properly seated against the tubing. To do this the skate presents a planar surface, along which the gripping elements move. In this example, in which gripping elements have rollers on their back sides, the rollers 152 roll along planar rolling surface 150 while the grippers engage tubing within the gripping zone. The rollers roll or travel along a predetermined path that extends the length of the planar rolling surface. The planar rolling surface extends along a central portion 154 of the skate, which coincides with the gripping zone, but tapers away from the chain in transition zones 156 at the ends of the skate. The rolling surface is parallel to the axis of tubing 109 as it passes through the gripping zone. Each gripper 106 has attached to it a roller 152. In the illustrated embodiment, and best shown by FIG. 1, each roller is comprised of two cylindrical elements mounted for rotation on a common axis.

Although the skate illustrated in the figures is embodied as a single, beam-like element having a flat, planar surface on one side, it is intended to be representative. The skate may also be constructed as multiple elements that are joined together or otherwise held in a position relative to each other in manner that they present collectively a planar rolling surface.

During operation of the injector, when the tubing has been lowered into the well bore to the point that the weight of the tubing and tools attached to it exceeds the hydrostatic well pressure, the load on the tubing, and thus the stress on the tubing being held by the injector, is a function of the difference between the total weight of the tubing in the hole and attached tools, and the hydrostatic pressure within the well. The tensile stress on the tubing will be greatest at the bottom of the injector, where it enters the gripping zone, and will be near zero at the top of the injector, at the point the tubing exits the gripping zone. (The reel on which the tubing is wound will place tension on the tubing as it exits the injector head.) Thus, the strain in the tubing will be greatest at the bottom of the gripping zone, near the well bore, and near zero at the top of the gripping zone. The stress, and thus the strain, on the gripper chains is, however, the inverse. As tubing 109 extends upwardly through the gripping zone, it shortens, but the chain lengthens. The contraction of the tubing and the lengthening of the chain generates an axial force. Essentially, stress that is being relieved is being at least partly transferred to the gripper.

Formed on each rolling surface 150 of skates 146 and 148 are one or more strain relief regions. In the illustrated embodiment, there are three strain relief regions in the form of shallow grooves 160*a*, 160*b* and 160*c* that are formed (such as by machining or otherwise) on the central portion of the skate at three, predetermined, spaced-apart locations, within the gripping zone. The strain relief regions allow for a predetermined lateral movement of the roller 152 away from the tubing (and central axis of the gripping zone) and thus also of the gripper 106 to which it is attached, that momentarily at least partially unloads the normal force.

The momentary lateral movement or displacement of the gripping element results in a reduction of the normal force being applied by the gripping element. However, the reduction or removal of the normal force does not necessarily result in the loss of contact between the gripping surface of the gripper elements and the tubing, the amount of the reduction is substantial and sufficient enough to reduce friction between the gripping element and the tubing to a point at which relative movement of the tubing and the gripping element can occur.

Each of the one or more strain relief regions on a skate, in effect, divides the gripping zone for the gripper into at least one strain relief segment between two or more traction segments. Each strain relief segment allows a gripping element, as it moves between the traction segments, to reset its position on the tubing while gripping elements within the traction segments continue to generate axial force for gripping the tubing.

In the illustrated embodiment the widths 162*a*-162*c* of the grooves 160*a*-160*c* are the same. Furthermore, the transitions from the planar rolling surface 150 to the groove are curved, allowing for a more gradual reduction and smoother rolling. The length of the strain relief regions, which correspond in the illustrated embodiments to the widths of the grooves (and thus the length of the strain relief region), determines the time during which the normal force being applied by a gripping element tubing is reduced. In one example, the width of the groove is approximately the width of the roller when the roller is centered and touching the deepest point of the groove. In an alternative embodiment the groove is widened to lengthen the time during which the normal force applied to the gripper is substantially decreased or removed and the tubing permitted to slip relative to the gripper.

In the illustrated example there are three strain relief regions, spaced equally apart on the skate. However, in an alternative embodiments, the strain relief regions need not be evenly spaced apart. Alternative embodiments may also have fewer or more than three stress relief points. Furthermore, in embodiments of skates with multiple strain relief regions, the lengths of two or more of strain relief regions (e.g. the widths of the grooves 160*a*-*c*) can be different from each other.

In the illustrated example, the grooves 160*a*-160*c* on each skate are aligned so that gripping elements on opposite sides reset at the same time. However, in alternate embodiments, these may be offset.

Strain relief regions may be formed, in alternative embodiments, by indentations, concavities, or slots of different shapes, by gaps between segments or pieces of a multi-piece skate, or by any other type of interruption in the planar rolling surface of the skate that results in at least a controlled and/or predetermined reduction of the normal force being applied by a gripping element moving past the strain relief region, in an amount sufficient for permitting relative movement of the gripper with respect to the tubing during the period in which it is within the strain relief region.

One potential benefit of controlled release of strain on the tubing as it is passing through the injector is the reduction of the risk of runaway slips. Because the pulling force of the injector results from the normal force applied to the gripper multiplied by the coefficient of friction, the capacity of a gripping element to create a pulling force is dramatically reduced once relative motion between a gripping element and tubing starts. Once a gripping element or set of gripping elements begin to move relative to the tubing, the axial force that results from the applied normal force and friction fall dramatically. Friction coefficients for steel on steel depend on steel hardness, surface finish or condition, and lubrication. The static coefficients of friction for steel on steel of the type used for tubing and grippers range between 0.75 and 0.11, dry and lubricated, respectively. The dynamic coefficients drop to 0.42 to 0.03 for dry and lubricated surfaces. The coefficient of friction varies dramatically when static contact between the tubing and the gripper changes to dynamic. If gripping falls to the point that the injector can no longer generate enough axial force to hold on to the tubing, a "runaway" slip occurs, resulting in loss of control of the tubing and sliding damage to the outside of the tubing along with possible damage to the gripping elements. Increasing the normal force to increase friction may damage the tubing. Controlled relief of strain through the gripping zone, in the manner described above, tends to reduce the risk of runaway slips.

The foregoing description is of an exemplary and preferred embodiments employing at least in part certain teachings of the invention. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated structures or the disclosed embodiments.

What is claimed is:

1. A coiled tubing injector, comprising:

a plurality of elongated gripper chains, each of which is comprised of continuous chain loop having mounted thereon a plurality of gripping elements, the plurality of gripper chains each having sections that are arranged to form between them a gripping zone for gripping tubing when placed between sections of the gripping chains, the gripping zone having a central axis aligned with the center axis of tubing passing through the gripping zone;

a drive system coupled with at least one of the plurality of gripper chains;

for each gripping chain in the plurality of gripping chains, at least one skate extending behind the sections of the gripping chains that form between them the gripping zone for causing gripping elements on the chain to apply to tubing, when passing through the gripping zone, a force normal to the surface of the tubing;

wherein at least one of the at least one skate behind at least one of the plurality of gripper chains has formed thereon at least one strain relief region for dividing the gripping zone into a strain relief segment between two traction segments, the strain relief region reducing the amount of the force a gripping element applies when it moves into the strain relief segment as compared to what it applies when it is located within either of the two traction segments.

2. The injector of claim 1, wherein the amount of reduction in the force is sufficient for permitting a gripping element within the strain relief segment to slide with respect to tubing when passing through the strain relief segment, without causing loss of traction by gripping elements on the chain within the traction segments.

3. The injector of claim 1, wherein each of the skates have formed thereon one or more planar surfaces, along which the gripping elements on each of the plurality of gripper chains ride when they are within the gripping zone, and wherein the strain relief region comprises an interruption in the planar surface for allowing a gripper within the strain relief segment to move laterally away from the tubing.

4. The injector claim 3, wherein the interruption is comprised of one of a groove, slot, gap, concavity, or depression.

5. The injector of claim 1, wherein the skate between each of the plurality of gripper chains has formed thereon the at least one strain relief region for dividing the gripping zone into a strain relief segment between two traction segments, the strain relief region on the skate reducing the amount of the force a gripping element applies when it moves into the strain relief segment as compared to what it applies when it moves within either of the two traction segments.

6. A coiled tubing injector, comprising:

a plurality of elongated gripper chains, each of which is comprised of continuous chain loop having mounted thereon a plurality of gripping elements; the plurality of gripper chains each having sections that are arranged to form between them a gripping zone for gripping tubing, the gripping zone having a central axis aligned with the center axis of tubing passing through the gripping zone; and each of the plurality of gripping elements on each of the gripper chains comprises at least one roller;

a drive system coupled with at least one of the plurality of gripper chains;

for each gripping chain in the plurality of gripping chains, a skate extending behind the section of the gripping chain for causing gripping elements on the chain to apply to tubing when passing through the gripping zone a force normal to the surface of the tubing sufficient to grip, the skate having a planar rolling surface extending along at least a portion of its length, along which the rollers of the plurality gripping elements roll on a predetermined path when within the gripping zone;

wherein the planar rolling surface of the skate behind at least one of the plurality of gripper chains comprises at least one interruption between the ends of the rolling surface, into which the at least one roller on the plurality of gripping elements may roll when the plurality gripper chains are rotated, the interruption having a predetermined depth and width on a portion of the planar rolling surface on each side.

7. The injector of claim 6, wherein the interruption accommodates a predetermined lateral movement away from the center axis of the gripping zone by the at least one roller of at least one of the plurality of gripping elements.

8. The injector of claim 6, wherein the interruption comprises one of a groove, slot, gap, depression or concavity.

9. The injector of claim 6, wherein the planar rolling surface of the skate behind at least one of the plurality of gripper chains comprises at least two interruptions, each of which has a predetermined depth and width and a portion of the planar rolling surface on either side of the interruption, along the path of the rollers.

10. The injector of claim 6, wherein the planar rolling surface of the skate behind each of the plurality of chains has at least one interruption.

11. The injector of claim 10, wherein the interruptions in the planar rolling surfaces of each of the skates are aligned with each other.

12. A method for controlling the strain on tubing extending through a coiled tubing injector, a plurality of elongated gripper chains, each of which is comprised of continuous chain loop having mounted thereon a plurality of gripping elements, the plurality of gripper chains having sections that are arranged with respect to each other to form between them a gripping zone for gripping tubing, the gripping zone having a central axis aligned with the center axis of tubing passing through the gripping zone;

driving at least one of the plurality of chains with drive system to move tubing passing through the gripping zone;

applying a uniform force to the plurality of gripping elements when with the gripping zone;

momentarily reducing the pressure on at least one of the plurality of gripping elements when in at least one predetermined strain relief segment at an intermediate location within the gripping zone, while maintaining the pressure on the remaining ones of the plurality of gripping elements within the gripping zone but outside the at least one predetermined strain relief segment, the reducing of pressure allowing the at least one gripping element to reset its position with respect to the tubing without causing the remaining ones of the plurality of gripping elements to lose grip on the tubing.

13. The method of claim 12, wherein the momentary reduction in the pressure on the at least one of the plurality of gripping elements occurs in a plurality of predetermined strain relief zones spaced apart at intermediate locations within the gripping zone.

* * * * *